US006010597A

United States Patent [19]

Stotz

[11] Patent Number: 6,010,597

[45] Date of Patent: Jan. 4, 2000

[54] THREE-LAYER HEADBOX

[75] Inventor: Wolf-Gunter Stotz, Ravensburg, Germany

[73] Assignee: Voith Sulzer Papiermaschinen GmbH, Germany

[21] Appl. No.: 09/002,935

[22] Filed: Jan. 5, 1998

[30] Foreign Application Priority Data

Jan. 22, 1997 [DE] Germany ..... 297 01 032 U

[51] Int. Cl.[7] ..... D21F 1/06

[52] U.S. Cl. ..... 162/336; 162/343

[58] Field of Search ..... 162/336, 343, 162/338

[56] References Cited

U.S. PATENT DOCUMENTS

| | | | |
|---|---|---|---|
| 4,086,130 | 4/1978 | Justus | 162/123 |
| 4,192,710 | 3/1980 | Bubik et al. | 162/198 |
| 4,909,904 | 3/1990 | Kinzler | 162/343 |
| 5,609,726 | 3/1997 | Sollinger | 162/125 |
| 5,688,374 | 11/1997 | Begemann et al. | 162/343 |

FOREIGN PATENT DOCUMENTS

| | | |
|---|---|---|
| 3227218 | 1/1984 | Germany . |
| 4225297 | 2/1994 | Germany . |
| 8102903 | 10/1981 | WIPO . |

*Primary Examiner*—Peter Chin
*Assistant Examiner*—Steven Leavitt
*Attorney, Agent, or Firm*—Ostrolenk, Faber, Gerb & Soffen, LLP

[57] ABSTRACT

A headbox for suspension having an inlet, an outlet and a suspension guide within the headbox. The headbox provides three layers of suspension. A first transverse suspension supply distributor extending laterally across the headbox for supplying the middle layer of suspension. A second transverse distributor extending across the lateral width of the headbox, of a generally horseshoe shape for partially enclosing the first distributor and the legs of the U of the second distributor providing suspension for the outer two layers of the three layers. The suspension supply to each distributor is either from the same lateral side or from opposite lateral sides of the headbox. Each distributor tapers narrower in cross section from the suspension supply at one side toward the opposite lateral side. The guide in the headbox is at each of the three layers.

11 Claims, 3 Drawing Sheets

THREE-LAYER HEADBOX

BACKGROUND OF THE INVENTION

The invention relates to a three-layer headbox of a machine for producing a fiber web, especially a paper web.

A three layer headbox is known, for example, from DE 32 27 218 A1. For supplying each of the layers of suspension to the headbox, a respective transverse distributor extends across the headbox, is fastened to the basic housing or body of the headbox and supplies the respective layer of the headbox with stock suspension over the machine width. Because of their hydraulic requirements, the transverse distributors are usually relatively voluminous and their arrangement produces an overall size which is not needed by the headbox. This causes space problems when the headbox is arranged on the paper machine and produces unnecessary manufacture, materials and space costs.

SUMMARY OF THE INVENTION

It is therefore the object of the invention to develop a three-layer headbox having transversely extending distributors which are of more compact construction than in known multilayer headboxes.

This object is achieved by a headbox having a first transverse distributor that serves more than one, but fewer than all, of the layers, that preferably serves two layers that are not adjacent and that particularly serves the two outer layers of a three-layer headbox while another distributor serves the middle layer.

Accordingly, a headbox for producing a three-layer fiber web, especially a paper web, has a machine width outlet nozzle for the stock suspension, at least one guide device in the headbox, and two machine width, transverse direction suspension distributors particularly with their stock supply delivered from one side. The first transverse distributor supplies the middle suspension layer, and the second transverse distributor supplies the two outer suspension layers. Preferably, the second transverse distributor is shaped to surround the first transverse distributor in a horseshoe shape or U-shape. The resulting nested configuration of the transverse distributors enables the connections on the flowbox side leading to the transverse distributors to be placed very close to one another, which can greatly reduce the overall size of the headbox. Furthermore, only a single suspension supply line is needed for supplying suspension for the two outer layers. In contrast with the prior art, only two pumps are needed instead of the three pumps that are needed with three separate transverse distributors.

In an advantageous refinement, the free inner cross section of the transverse distributors in each case narrows from one side of the machine to the other, enabling constant suspension pressure over the machine width.

In one further refinement, the cross sections of the two transverse distributors narrow in the same direction, that is, the conicity of the transverse distributors runs in the same direction. This design enables the side supplies to the two transverse distributors to be at one side of the machine. If applicable, the discharges of excess stock suspension from the two transverse distributors may also be implemented at one side of the machine. In an alternate refinement, the supplies to the distributors may be from opposite sides of the machine. Then the distributors would narrow from opposite directions, to keep uniform pressure over the machine width and to keep substantially uniform cross section of the combined distributors across the width.

In the headbox described above, in addition to the stock being supplied via the transverse distributors to the guide device in the headbox, it is also advantageous to provide a large number of additional, individually adjustable supply lines for other suspension, wire water collected from a dewatering step, paper stock additives, etc. By this means, by regulating the quantities and flow rate of suspension supplied per section across the width of the headbox and/or compositions of the suspension in each section over the width of the headbox, the sectional overall volume flow at various sections across the width of the headbox and/or the suspension composition in one or more suspension layers can be influenced, and the mass transverse profile or the fiber orientation transverse profile of the resulting paper web produced can be corrected. In this connection, refer to the designs of U.S. Pat. Nos. 4,909,904; 5,885,420; and 5,609,726, incorporated by reference. All the possibilities of sectional stock supply as used in a single-layer headbox are also available to be used for each layer in a three-layer headbox.

The configurations of the transverse flow distributors of the three-layer headbox has additional advantages:

The strength of the joint between the inner transverse flow distributor and the step diffuser block need only correspond to the dead weight of the inner distributor (without a water filling), plus the reaction of the flow in the step diffusers of the inner layer. The pressure and the filling in the inner distributor is irrelevant, since the latter is compensated by the pressure and the buoyancy of the outer distributor.

Mechanical inaccuracies in the inner distributor are substantially compensated for by the flow of the outer distributor. Only two instead of three stock supply and discharge systems are needed, one for the inner layer and one for the two outer layers.

Other objects, features and advantages of the present invention will become apparent from the following description of the invention which refers to the accompanying drawings.

BRIEF DESCRIPTION OF THE DRAWINGS

The invention is described below in a specific configuration form. In detail.

DETAILED DESCRIPTION OF THE INVENTION

Figure 1:
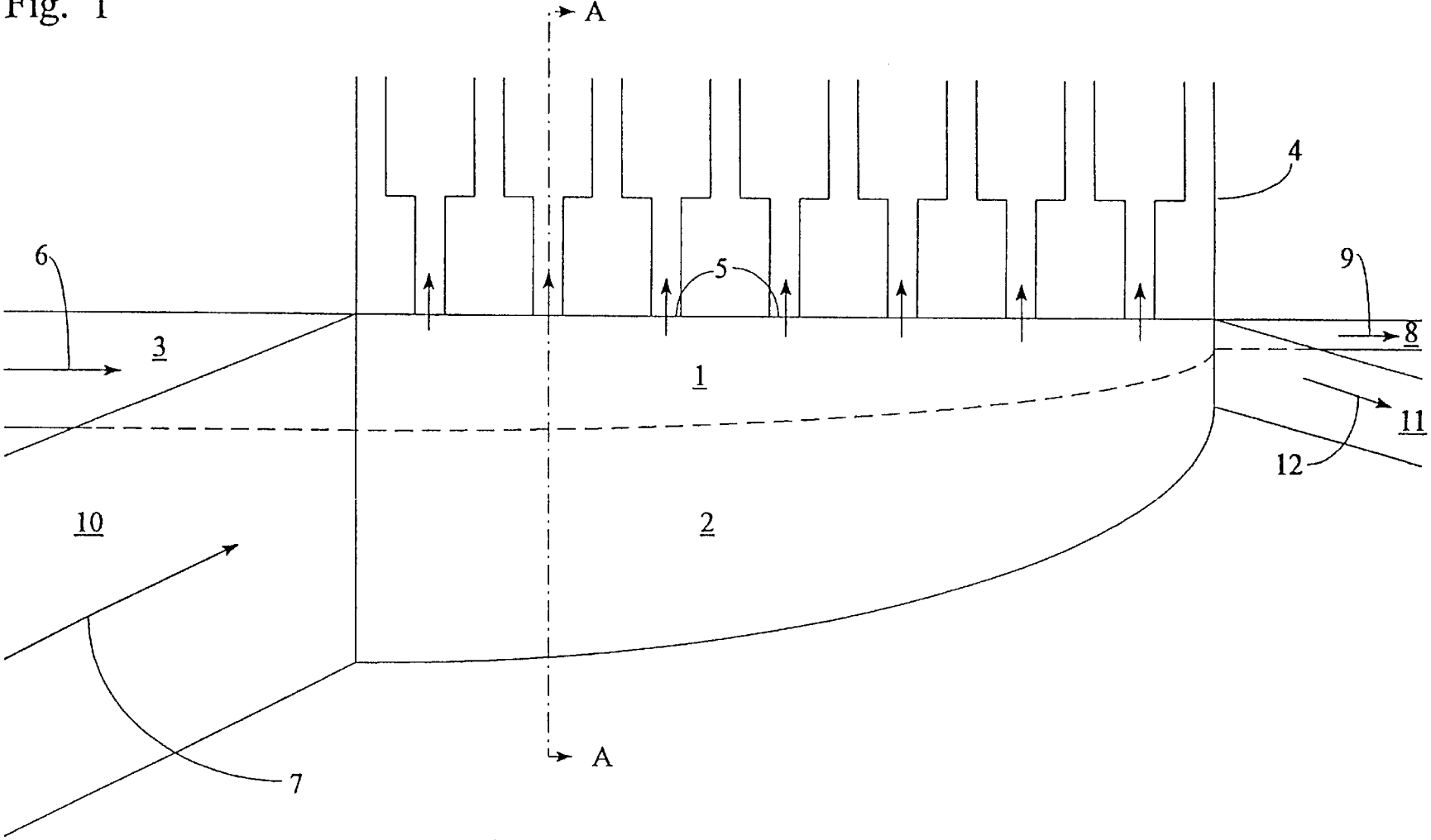
FIG. 1 shows a section from the top or the bottom at B—B from FIG. 2 through a three-layer headbox according to the invention in the region of the transverse distributors.
Figure 2:
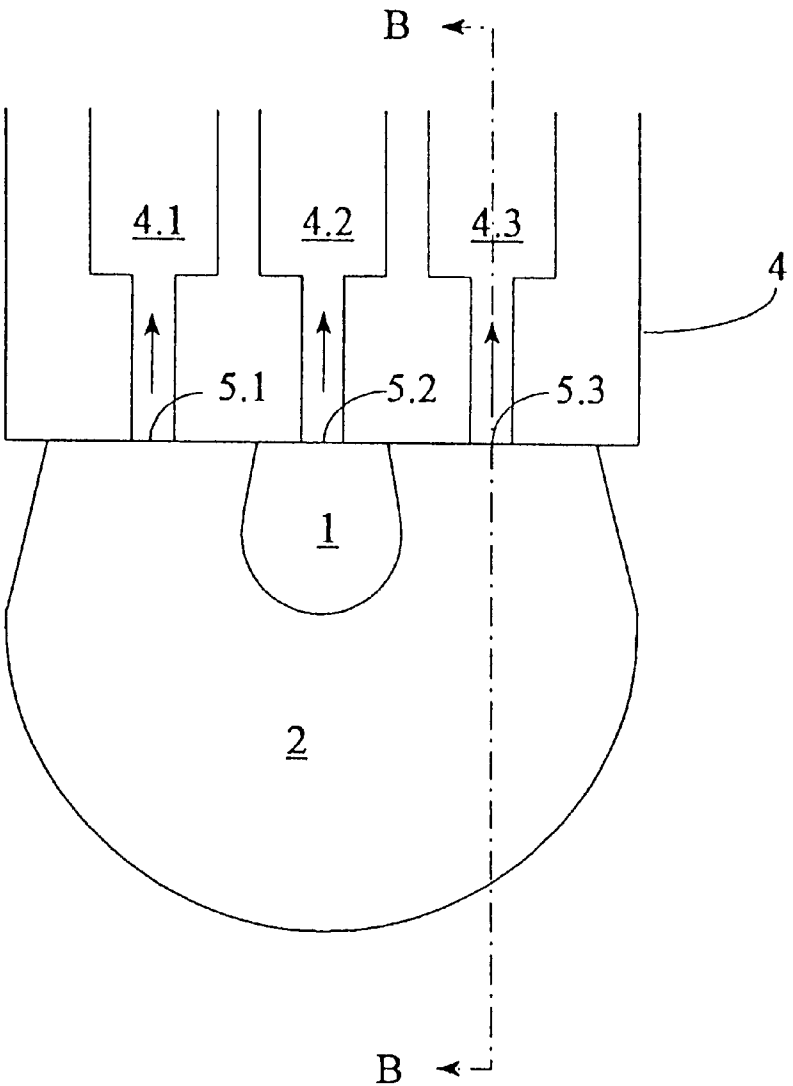
FIG. 2 shows a side-cross sectional section A—A from FIGS. 1 and 3 through a three-layer headbox according to the invention in the area of the transverse distributors.

FIG. 1 shows a section through a schematically illustrated three-layer flowbox according to the invention in the area of the transverse distributors. The two transverse distributors 1 and 2 are illustrated. The first transverse distributor 1 runs through the wrapped around second transverse distributor 2, and the second distributor 2 wraps around the first distributor 1 in a generally horseshoe shape or a U, as seen in FIG. 2.

The first transverse distributor 1, lying on the inside of the second distributor 2, is connected to a stock or pulp suspension supply 3 and supplies the stock suspension flow 6 to the suspension guide device 4 of the middle layer. The guide device 4 has a row of channels in an array across the width of the headbox and each directs flow along the headbox for a uniform pressure distribution across the inlet openings 5 to all of those channels and distributed across the machine width of the guide device 4. The first transverse distributor 1 narrows in a generally parabolic shape along the flow direction through the distributor across the width of the headbox. A discharge 8 is fitted at the end of the first transverse distributor 1 which discharges the excess stock suspension 9 from the middle layer.

The second transverse distributor 2 wraps around the first transverse distributor 1 in an approximately "horseshoe shape" or U-shape. The legs of the U extend toward and open toward inlet side of the headbox. The second distributor is fed from the second suspension or stock supply 10, and the second distributor leads the stock suspension flow 7 to the guide devices in the headbox for the outer layers. As in the case of the first transverse distributor 1, a discharge 11 is also provided for the excess stock suspension 12 from the second distributor.

In the illustrated design, the outer wall of the first transverse distributor 1 forms the inner wall of the second transverse distributor 2 which lies on the outside. The flow is directed in the two transverse distributors 1, 2 in the same direction. Hence, the stock supplies to both distributors are both arranged on the same lateral side of the headbox and the discharges from both the distributors are on the same opposite lateral side of the headbox. In spite of the compact construction, a simple pipe run on the paper machine is made possible.

FIG. 2 shows a section A—A from FIG. 1, through a three-layer headbox of the invention in the area of the transverse distributor. The first transverse distributor 1, which lies on the inside, feeds the middle guide device using a large number of pipes 4.2. The transverse distributor 2, which lies on the outside, surrounds the first transverse distributor 1 in a "horseshoe shape" or U-shape, and connects the two outer guide devices to the outer two pipe bundles 4.1 and 4.3, respectively. In this compact construction of this headbox, however, it is no longer possible to differentiate between the guide devices of the individual layers. In this case, the first transverse distributor exclusively feeds turbulence generating units of the middle layer, and the second transverse distributor feeds those of the outer layers.

Figure 3:
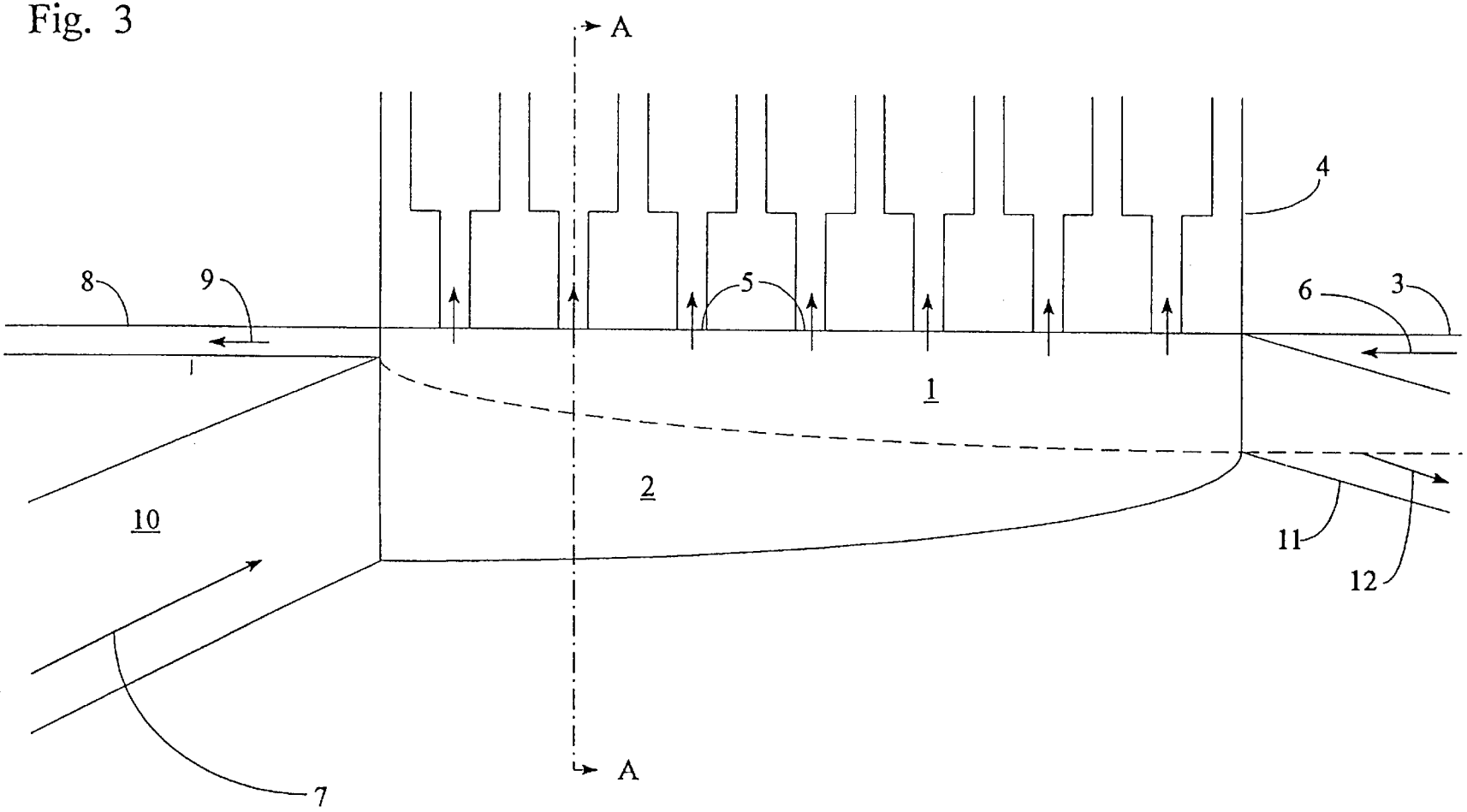
FIG. 3 shows a section also at B—B from FIG. 2 through a three-layer headbox according to the invention in the area of the transverse distributors, in a countercurrent design.

FIG. 3 is a section B—B from FIG. 2 through a three-layer flowbox according to the invention in the area of the transverse distributor but in a countercurrent design which differs from the design of FIG. 1. The transverse distributors are configured such that the flow directions in the two distributors run counter to each other, and hence their conicity, and particularly their generally parabolic shapes, are also oppositely directed. In this embodiment, the smallest cross section of each transverse distributor is paired with the largest cross section of the other transverse distributor. This design enables optimal use of the space in the area of the distributor. However, this construction necessitates that the stock suspension supply and discharge ends be arranged at alternate lateral sides of the machine. This design may be advantageous depending on the available space for the pipelines.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A headbox for producing a three layer fiber web, comprising:

an inlet side to which pulp suspension is delivered at three height levels for forming the three layers of the fiber web;

lateral sides defining a width dimension across the headbox and the width of the layers;

a spaced apart top and bottom joining the lateral sides;

an outlet for dispensing the pulp suspension which has passed through the headbox;

a guide device disposed between the inlet and the outlet for guiding the flow in a flow direction from the inlet to the outlet;

a first transverse distributor extending between the lateral sides of the headbox for delivering a first supply of pulp suspension to the inlet of the headbox at the middle one of the suspension layers between the top and the bottom of the headbox; and a second transverse distributor also extending between the lateral sides of the headbox and communicating to the inlet of the headbox at the two outer suspension layers between the top and bottom of the headbox.

2. The headbox of claim 1, wherein the first transverse distributor includes a first chamber therein between the lateral sides of the headbox through which the first supply of pulp suspension travels and the second transverse distributor includes a second chamber therein between the lateral sides of the headbox through which a second supply of pulp suspension travels, the second chamber being separated from the first chamber and the second chamber being shaped to partially enclose the first distributor.

3. The headbox of claim 2, wherein the second distributor is generally horseshoe shaped and wraps around the first distributor in a U having legs extending toward and opening at the inlet side of the headbox.

4. The headbox of claim 1, wherein each of the transverse distributors has a respective supply of suspension thereto, and each supply of suspension is toward one end of the respective distributor that is toward one of the lateral sides of the headbox.

5. The headbox of claim 4, wherein the first and second chambers of the first and second transverse distributors have respective first and second interior cross sections, the first and second cross sections of the first and second transverse distributors, respectively, tapering from the respective one end of each transverse distributor having the pulp suspension supply toward the opposite end of the distributor which is toward the opposite lateral side of the headbox.

6. The headbox of claim 5, wherein the pulp suspension supplies to the first and second transverse distributors are toward the same lateral side of the headbox.

7. The headbox of claim 6, wherein the interior cross sections of the first and second transverse distributors taper in the same direction across the headbox between the lateral sides.

8. The headbox of claim 5, wherein the pulp suspension supplies to the first and second transverse distributors are toward the opposite lateral sides of the headbox.

9. The headbox of claim 8, wherein the interior cross sections of the first and second transverse distributors taper in opposite directions across the headbox between the lateral sides of the headbox, wherein the cross section of one transverse distributor increases while the other decreases toward each lateral side.

10. The headbox of claim 1, wherein the guide device in the headbox comprises respective guide conduits in the headbox at and helping define each of the three layers with a plurality of the guide conduits at each layer and each of the guide conduits being of narrowed cross section for generating turbulence in the suspension passing in the respective layer and for guiding the suspension in the layer downstream through the headbox.

11. The headbox of claim 1, further comprising a plurality of additional individually adjustable supply lines for controlling the distribution of suspension at different locations across the lateral width of the headbox in the distributors and for controlling the composition of suspension in any of the suspension layers, wherein the supply lines communicate into the headbox at locations for influencing the distribution of suspension in the headbox over the lateral width of and among the three layers of suspension in the headbox.

* * * * *